US006257019B1

(12) United States Patent
Oakey et al.

(10) Patent No.: US 6,257,019 B1
(45) Date of Patent: Jul. 10, 2001

(54) PRODUCTION OF NITROGEN

(75) Inventors: John Douglas Oakey, Godalming; Paul Higginbotham, Guildford, both of (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/198,682

(22) Filed: Nov. 24, 1998

(30) Foreign Application Priority Data

Nov. 24, 1997 (GB) ..... 9724787

(51) Int. Cl.[7] ..... F25J 3/00; F25J 5/00
(52) U.S. Cl. ..... 62/646; 62/650; 62/900
(58) Field of Search ..... 62/643, 646, 650, 62/900

(56) References Cited

U.S. PATENT DOCUMENTS 5,006,139 * 4/1991 Agrawal et al. ..... 62/650
5,123,947 6/1992 Agrawal .
5,137,559 8/1992 Agrawal .
5,233,838 8/1993 Howard .
5,341,646 * 8/1994 Agrawal et al. ..... 62/646
5,402,647 4/1995 Bonaquist et al. .
5,440,885 8/1995 Arriulou .
5,682,762 11/1997 Agrawal et al. .
5,761,927 * 6/1998 Agrawal et al. ..... 62/643

FOREIGN PATENT DOCUMENTS 0182620 5/1986 (EP) .
0 733 869 9/1996 (EP) .

* cited by examiner

*Primary Examiner*—William Doerrler
(74) *Attorney, Agent, or Firm*—Wan Yee Cheung; Salvatore P. Pace

(57) ABSTRACT

Nitrogen is produced by separation of it from air. Nitrogen so separated is condensed. Most or all of the nitrogen is separated by rectification. At least some of the condensed nitrogen is employed as reflux in the rectification. The nitrogen is both separated and condensed at three or more different pressures.

17 Claims, 7 Drawing Sheets

PRODUCTION OF NITROGEN

BACKGROUND OF THE INVENTION

This invention relates to a method of and apparatus for producing nitrogen by the separation of air.

The separation of air by rectification is very well known indeed. Rectification is a method in which mass exchange is effected between a descending stream of liquid and an ascending stream of vapor such that the ascending stream of vapor is enriched in a more volatile component of the mixture to be separated and the descending stream of liquid is enriched in a less volatile component of mixture to be separated.

Conventionally, air is separated in a double rectification column comprising a higher pressure rectification column, a lower pressure rectification column, and a condenser-reboiler, of which the condensing passages communicate with an upper region of the higher pressure rectification column and the reboiling passages communicate with a lower region of the lower pressure rectification column. Nitrogen is thereby separated in the higher pressure rectification column and is condensed in the condenser-reboiler. Part of the resulting condensate is used as reflux in the higher pressure column and another part of the condensate is so used in the lower pressure rectification column. An oxygen-enriched liquid air fraction is taken from the bottom of the higher pressure rectification column and is introduced into an intermediate mass exchange region of the lower pressure rectification column. A nitrogen fraction is obtained at the top of the lower pressure rectification column and an oxygen-enriched fraction at its bottom. A nitrogen product is therefore obtained at the pressure of the lower pressure rectification column. Many industrial processes, for example, the enhanced recovery of oil or gas, require nitrogen to be supplied at an elevated pressure, often well in excess of that at which the higher pressure rectification column operates. In order to reduce the amount of work required to raise the pressure of the nitrogen product from that of the lower pressure rectification column to that demanded by the process to which the nitrogen is to be supplied, it is known to take some of the nitrogen product as vapor from the higher pressure rectification column. A feature of such processes is that for a given size of air separation plant and a given purity and pressure of the nitrogen product, the total power consumption at first falls with increasing nitrogen recovery to a minimum and then rises again. This phenomenon results from two opposing factors. The ideal separation work (and hence power consumption) is at a minimum when the nitrogen recovery is very low and the waste product is still essentially air. It is at a maximum when the waste gas contains no nitrogen. However, the process efficiency (actual work input/ideal work input) is very low when the recovery is very low because the plant is much bigger than it needs to be and losses of work arising from pressure drops and temperature differences are large. Conversely, when the recovery is high, the process efficiency is higher. As the recovery is reduced from 100%, there is a minimum power at an optimum recovery, where the falling separation power is just balanced by the increasing losses of work that are caused by the plant getting larger. The total power consumption of the process also typically includes the power consumed in compressing the nitrogen product. Taking a part of the nitrogen product from the higher pressure column reduces the power consumed in compressing the nitrogen products but reduces the nitrogen recovery.

Other expedients may also decrease the nitrogen recovery. For example, the production of a liquid nitrogen product requires a part of the incoming air to be condensed. This in turn reduces the vapor flow available for condensation in the condenser-reboiler. Again, in order to compensate a larger, less efficient, plant is required.

In practice, known double column air separation plants for generating nitrogen are not necessarily designed either for a minimum power consumption or for maximum nitrogen recovery. Rather, there is generally a preferred operational envelope represented by a particular region of a graph of power consumption plotted against nitrogen recovery, the actual optimum depending on extraneous economic circumstances. It is aim of the present invention to provide methods and apparatuses for producing nitrogen which effectively enable the preferred operational envelope to be shifted in the direction of reduced power consumption without reducing nitrogen recovery, or in the direction of increased nitrogen recovery without increasing power consumption, or in both directions.

SUMMARY OF THE INVENTION

According to the present invention there is provided a method of producing nitrogen, comprising separating nitrogen from air and condensing nitrogen so separated, wherein most or all of the nitrogen is separated by rectification and some of the condensed nitrogen is employed as reflux in the rectification, characterized in that the nitrogen is both separated and condensed at three or more different pressures.

The invention also provides apparatus for producing nitrogen, comprising an arrangement of separation vessels for separating nitrogen from air, some or all of the separation vessels being rectification columns, a plurality of condensers for condensing the nitrogen being arranged to return, in use, at least some of the condensed nitrogen to the arrangement of rectification columns to serve as reflux therein, characterized in that three or more of the nitrogen condensers are arranged to condense nitrogen at different pressures from one another and are in communication with different separation vessels which in turn are operable at different pressures from one another.

By separating and condensing nitrogen at three or more different pressures, the nitrogen condensation load is shared between the condensers, thus enabling relatively efficient operation (e.g. with relatively low power consumption) of the overall air separation process to be maintained under conditions of relatively high nitrogen recovery which would otherwise lead to inefficient operation of a conventional process employing but a single nitrogen condenser, for example, a conventional double rectification column process. In particular the method and apparatus according to the present invention allow the lowest pressure separation to be conducted at a pressure in excess of 3.5 bar absolute while at the same time enabling a nitrogen product to be taken, particularly in vapor state, from the highest pressure separation which is typically conducted at a pressure in excess of 8.5 bar absolute. In a typical example, at constant air compression power, about 80% of the total nitrogen product may be produced at the highest separation pressure at about 86% nitrogen recovery, whereas in a comparable conventional double column process only 60% of the total nitrogen product is produced at the pressure of the higher pressure rectification column. Because a greater proportion of the nitrogen is taken from the higher pressure rectification column, the total power consumption is reduced when producing a nitrogen product at a pressure above that of the higher pressure rectification column. Taking an increased share of the nitrogen product from the higher pressure rectification column is not the only way of realizing a lower power consumption. It is alternatively possible in some examples of the method and apparatus according to the invention to keep this share constant, and reduce the power consumed in compressing the air while essentially maintaining nitrogen recovery. To enable this to be achieved an arrangement of columns comprising not only higher pressure and lower pressure columns, but also an auxiliary rectification column which receives air at a lower pressure then the higher pressure column, is typically used. The method and apparatus according to the invention alternatively make possible at a given nitrogen recovery and power consumption storage of a liquid nitrogen product at a greater rate than in comparable known processes.

The nitrogen is preferably separated at the same pressures at which it is condensed. This avoids the need to employ additional apparatus, within inherent thermodynamic inefficiency, to change the pressure of the nitrogen at a position downstream of its separation and upstream of its condensation.

Some examples of the method and apparatus according to the invention separate all the nitrogen by rectification. Some of the nitrogen so separated may be impure. Typically, the nitrogen product contains less than 0.1 per cent by volume of impurities. In other examples, however, some impure nitrogen, typically containing from 10 to 15% by volume of oxygen, is separated by partially vaporizing a liquid air stream or a liquid stream comprising oxygen and nitrogen taken from the rectification, and disengaging the resulting vapor from the residual liquid. In such an example, one of the separation vessels is a phase separator adapted to separate a mixture of vapor and liquid formed by the partial vaporization. The vaporizer may be located upstream of or in the air separation vessels.

In some examples of the method and apparatus according to the invention the first stream of compressed vaporous air is separated in a double rectification column; in other examples it is separated in a triple rectification column. Examples in which a double rectification column is employed will be discussed first.

Preferably, in double rectification column examples, the first stream of compressed vaporous air is separated in a double rectification column comprising a higher pressure rectification column in which nitrogen is produced at a first pressure, a lower pressure rectification column in which nitrogen is produced at a second pressure lower than the first pressure, and a condenser-reboiler, of which the condensing passages communicate with an upper region of the higher pressure rectification column so as to condense nitrogen at the first pressure, and the reboiling passages communicate with a lower region of the lower pressure rectification column; and a stream of nitrogen is taken from an upper region of the lower pressure rectification column and is condensed at the second pressure in a first further condenser. Because there is typically no need to produce a pure oxygen fraction in the lower region of the lower pressure rectification column, this fraction may be relatively impure containing typically from 55 to 75% by volume of oxygen, and may therefore be used in the condensation of the nitrogen separated in the lower pressure rectification column. Accordingly, a stream of oxygen-enriched liquid is preferably withdrawn from the lower region of the lower pressure rectification column and is employed to condense the nitrogen at the second pressure.

In some examples of the method and apparatus according to the present invention, a second stream of compressed vaporous air has nitrogen separated from it in a first auxiliary rectification column at a third pressure and the nitrogen so separated is condensed in a second further condenser. The third pressure is less than the first pressure but greater than the second pressure. By employing the first auxiliary rectification column, a proportion of the air which would otherwise have to be compressed to the pressure of the higher pressure rectification column is able to be separated at the third pressure, thus reducing the total amount of work that needs to be employed in compressing the air and therefore making it possible to increase the overall efficiency of the air separation. Typically, some 30 to 50% of the total compressed air is separated in the first auxiliary rectification column.

The manner in which the second further condenser is operated will depend on the precise proportion of the feed air that is separated in the first auxiliary rectification column. When the proportion is at or close to 30%, all the nitrogen separated in the first auxiliary rectification column is preferably condensed. A stream of oxygen-enriched liquid is preferably withdrawn from the lower region of the higher pressure rectification column, is reduced in pressure and is indirectly heat exchanged with a flow of nitrogen separated in the first auxiliary rectification column so as to effect the condensation of the flow of nitrogen separated therein. The stream of oxygen-enriched liquid withdrawn from the higher pressure rectification is, downstream of its heat exchange with the flow of nitrogen separated in the first auxiliary rectification column, preferably subjected to separation in the lower pressure rectification column. If the proportion of the air which is sent to the first auxiliary rectification column separation is increased, it will be desirable either to increase the amount of refrigeration available to the second further condenser or to reduce the load on this condenser. The former may be achieved by using a stream taken from the lower region of the first auxiliary rectification column to cool the first condenser. The load on the second further condenser may be reduced by taking some of the nitrogen product as vapor from this column or by introducing liquid nitrogen from one of the other columns for this purpose.

A second auxiliary rectification column which separates a stream of liquid comprising oxygen and nitrogen may be employed in addition to or instead of the first auxiliary rectification column. Preferably, in examples of the method and apparatus according to the invention in which a second auxiliary column is employed, a stream of liquid comprising oxygen and nitrogen is withdrawn from a lower region of the higher pressure rectification column, is reduced in pressure, and has nitrogen separated therefrom in the second auxiliary rectification column at a fourth pressure which is less than the first pressure but greater than the second pressure, nitrogen so separated is condensed in a third further condenser, and liquid collecting in a lower region of the second auxiliary rectification column is reboiled. Typically, the nitrogen separated in the second auxiliary rectification column is impure, containing from 5 to 15% by volume of oxygen. If the second auxiliary rectification column is used instead of the first one, the stream of liquid which has nitrogen separated therefrom at the fourth pressure is typically enriched in oxygen. If, however, the second auxiliary rectification column is used in addition to the first auxiliary rectification column, the liquid stream may have approximately the same composition as air. The reboiler employed in association with the second auxiliary rectification column is typically heated by means of nitrogen taken as vapor from the higher pressure rectification column. In consequence, the amount of heating available to the condenser-reboiler forming part of the double rectification column is reduced. This has the advantage that optimization of the liquid-vapor ratio in the lower region of the lower pressure rectification column is facilitated, and thereby makes it possible to attain an increase in the thermodynamic efficiency at which the separation is performed in the lower pressure rectification column. The rate at which liquid can be taken from the lower region of the higher pressure rectification column for separation in the second auxiliary rectification column is, of course, limited by the rate at which nitrogen vapor can be taken from the higher pressure rectification column and used to heat the reboiler associated with the second auxiliary rectification column. Nitrogen employed to heat this reboiler is typically condensed by indirect heat exchange with the liquid that is reboiled therein.

Preferably, a stream of liquid is withdrawn from a lower region of the second auxiliary rectification column, is reduced in pressure, and is indirectly heat exchanged with a flow of nitrogen separated in the second auxiliary rectification column so as to effect the condensation of the nitrogen separated therein. A stream of liquid withdrawn from the second auxiliary rectification column is, downstream of its heat exchange with nitrogen, introduced into the lower pressure rectification column and separated therein.

There are various alternatives to the second auxiliary rectification column. One is to omit altogether liquid-vapor contact means from this column. When this is done, the column becomes, in effect, a phase separator, impure nitrogen being produced as the vapor phase. In such examples, a stream of liquid comprising oxygen and nitrogen is preferably withdrawn from a lower region of the higher pressure rectification column, is flashed through a valve so as to form at a fifth pressure less than the first pressure but greater than the second pressure a mixture of flash gas and residual liquid, the residual liquid is partially vaporized, resulting impure nitrogen gas is separated by being disengaged from the residual liquid, and the impure nitrogen gas is condensed at the fifth pressure. At least part of the condensed impure nitrogen is preferably introduced into an intermediate region of the higher pressure rectification column. Remaining impure condensed liquid nitrogen is preferably introduced into the lower pressure rectification column. Introduction of impure liquid nitrogen into the higher pressure rectification column helps to enhance the liquid-vapor ratio in the lower region of this column and thereby facilitates the withdrawal a nitrogen product from the top of this column. A stream of residual liquid is typically introduced into the lower pressure rectification column for separation therein.

Another alternative to the second auxiliary rectification column is to employ a reboiler with the first auxiliary rectification column. Such a reboiler enables nitrogen to be diverted from the condenser-reboiler forming part of the double rectification column and therefore has similar advantages to the second auxiliary rectification column.

If instead of a double rectification column, a triple column rectification column is employed, the first stream of compressed vaporous air is separated in the triple rectification column, which comprises higher pressure rectification column in which nitrogen is produced at a first pressure, a lower pressure rectification column in which nitrogen is produced at a second pressure lower than the first pressure, an intermediate pressure rectification column in which nitrogen is produced at a third pressure lower than the first pressure but higher than the second pressure, a first condenser-reboiler, of which the condensing passages communicate with an upper region of the higher pressure rectification column so as to condense nitrogen at the first pressure, and the reboiling passages communicate with a lower region of the intermediate pressure rectification column, and a second condenser-reboiler, of which the condensing passages communicate with an upper region of the intermediate pressure rectification column so as to condense nitrogen at the third pressure, and the reboiling passages communicate with a lower region of the lower pressure rectification column. A stream of liquid is preferably withdrawn from a lower region of the lower pressure rectification column, is reduced in pressure, and is indirectly heat exchanged in a first further condenser with a flow of nitrogen vapor separated in the lower pressure rectification column so as to condense the flow of nitrogen vapor.

Typically the nitrogen produced in the intermediate pressure rectification column is impure, and at least part of the condensate formed in the second condenser-reboiler is introduced into an intermediate region of the higher pressure rectification column. This measure helps to enhance the reflux ratio in the lower region of the higher pressure rectification column and reduce the reflux ratio in the upper region of the higher pressure rectification column, and thereby enables the rate at which nitrogen vapor is taken as product from the higher pressure rectification column to be enhanced.

An advantage of the triple rectification column over a conventional double rectification column is that it enables the condensation load which is met by the condenser-reboiler of the latter to be spread over the two condenser-reboilers of the former. It is therefore generally not advantageous to employ a first auxiliary rectification column in association with the triple rectification column. However, if desired, a rectification column analogous to the second auxiliary rectification column may be employed using a liquid stream from the lower region of the intermediate pressure rectification column as its feed. If desired, all liquid-vapor contact means may be omitted from this column so that it becomes in effect, a phase separator.

Irrespective of whether a double rectification column or a triple rectification column is employed in the method and apparatus according to the invention, it is typically advantageous to condense a third stream of compressed, vaporous, air to be separated, the condensation being performed in indirect heat exchange with a stream of condensed nitrogen taken from the higher pressure rectification column. The stream of condensed nitrogen taken from the higher pressure rectification column is preferably pumped to a higher pressure than the first pressure upstream of its heat exchange with the third stream of compressed, vaporous, air. The third stream of air may be partially or totally condensed. Partial condensation has the advantage that the average temperature difference between the condensing passages and the vaporizing passages of the condenser can be less than if the third air stream is totally condensed. The resulting partially or totally condensed third air stream may be used to provide further reflux for the rectification columns, particularly the higher pressure rectification column, in which it may be used to enhance the liquid-vapor ratio in the lower region thereof and reduce this ratio in the upper region, thereby enhancing the rate at which nitrogen product can be withdrawn from the higher pressure rectification column.

It is also advantageous in examples of the method and apparatus according to the invention in which either a double rectification column or a triple rectification column is used to compress a fourth air stream to be separated to a higher pressure than the first air stream, to expand the compressed fourth air stream with the performance of external work, and to introduce the expanded fourth air stream into either the lower pressure rectification column or the first auxiliary rectification column. This measure is another which helps to reduce the amount of air which needs to be separated in the higher pressure rectification column. The external work performed by the expansion of the fourth air stream is typically part of the work of compression of this stream. The expansion turbine (otherwise known as a turbo-expander) which is used to expand the fourth air stream provides refrigeration for the method and apparatus according to the invention.

The method according to the invention is particularly suited for operation at relatively elevated pressure. Thus, for example, the lower pressure rectification column of either a double or triple rectification column may operate at a pressure typically in the range of 3.5 to 6 bar at its top.

The air streams to be separated may be taken from a source of compressed air which has been purified by extraction therefrom of water vapor, carbon dioxide, and, if desired, hydrocarbons, and which has been cooled in indirect heat exchange with products of the air separation.

The term "rectification column" as used herein encompasses any distillation or fractionation column, zone or zones, in which liquid and vapor phases are countercurrently contacted to effect separation of a fluid mixture, as, for example, by contacting the vapor and liquid phases on packing elements or a series of vertically spaced trays or plates mounted within the column, zone or zones. A rectification column may comprise a plurality of zones in separate vessels so as to avoid having a single vessel of undue height.

BRIEF DESCRIPTION OF THE DRAWINGS

The method and apparatus according to the present invention will now be described by way of example with reference to the accompanying drawings, in which.

The drawings are not to scale. Like parts of different Figures are identified by the same reference numerals.

DETAILED DESCRIPTION OF THE INVENTION

Figure 3:
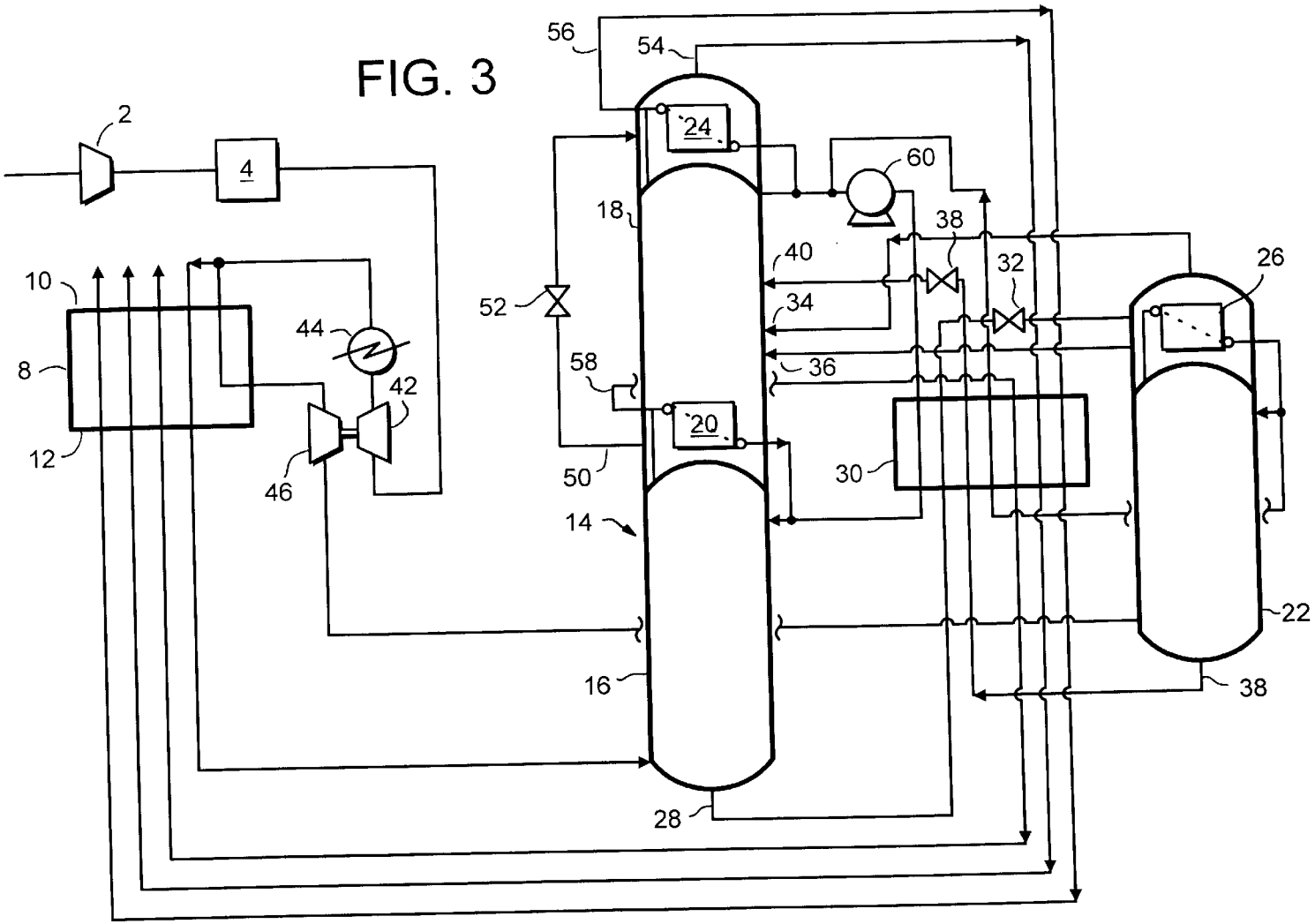
Figure 4:
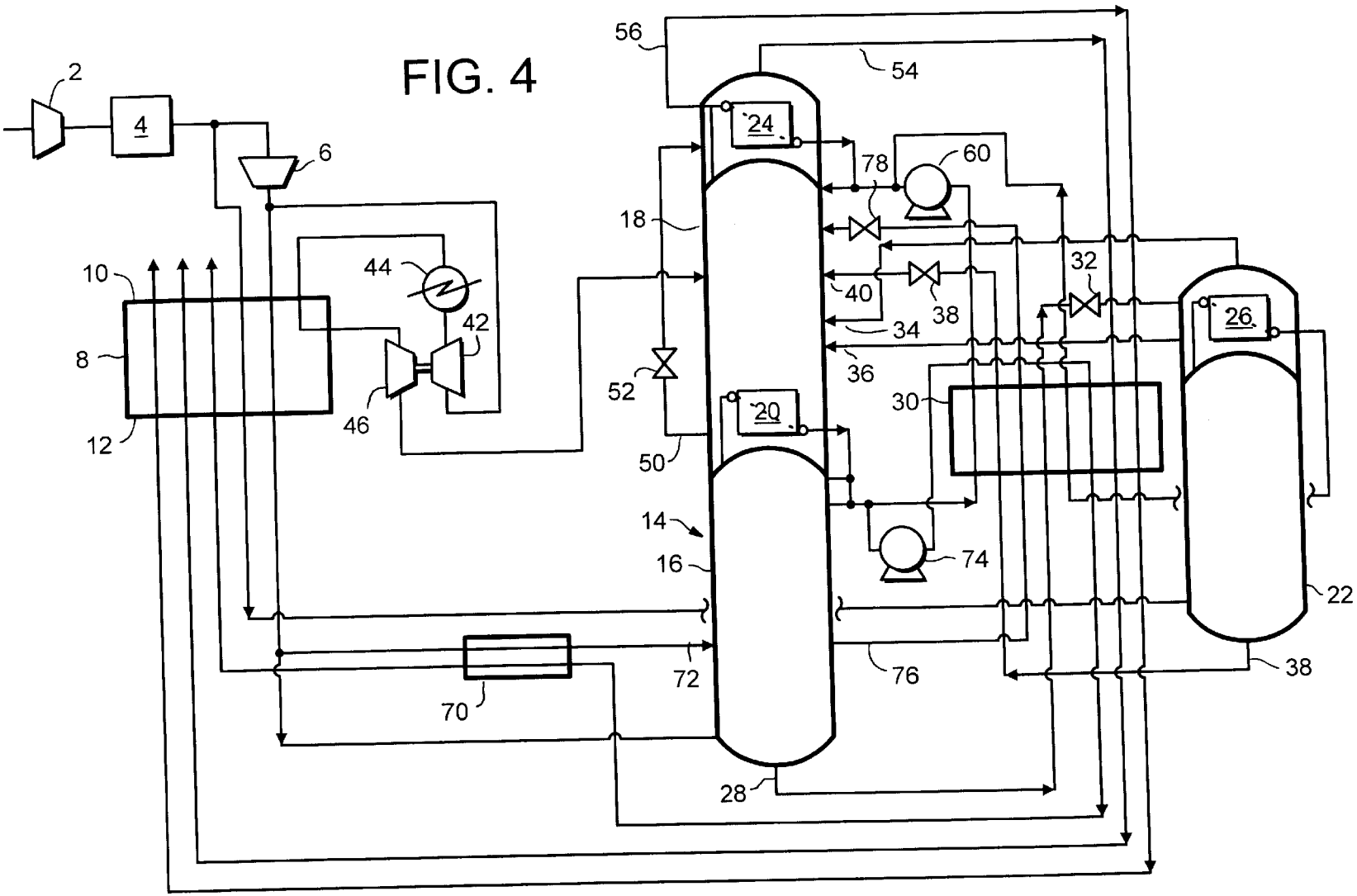
Figure 5:
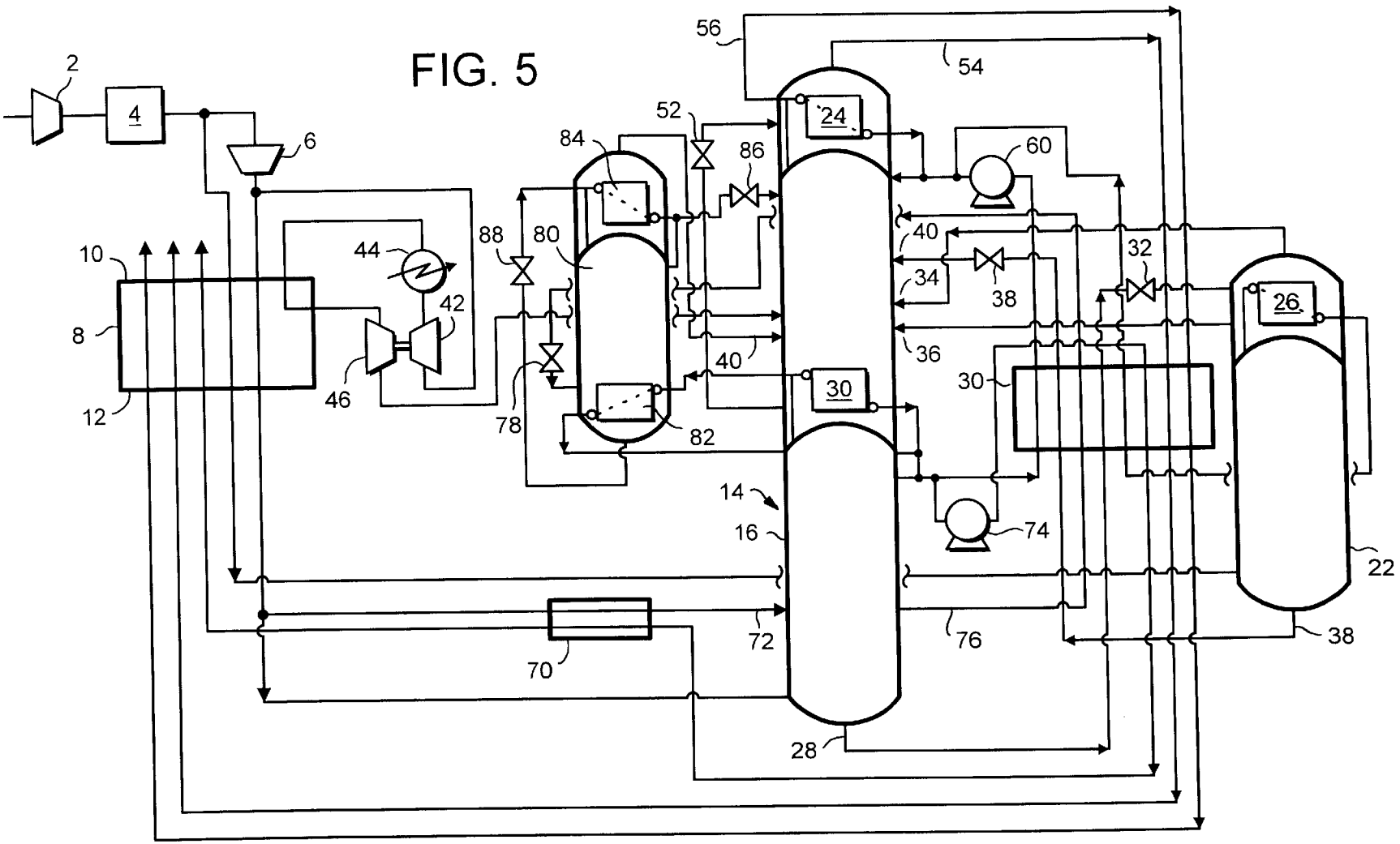
Figure 6:
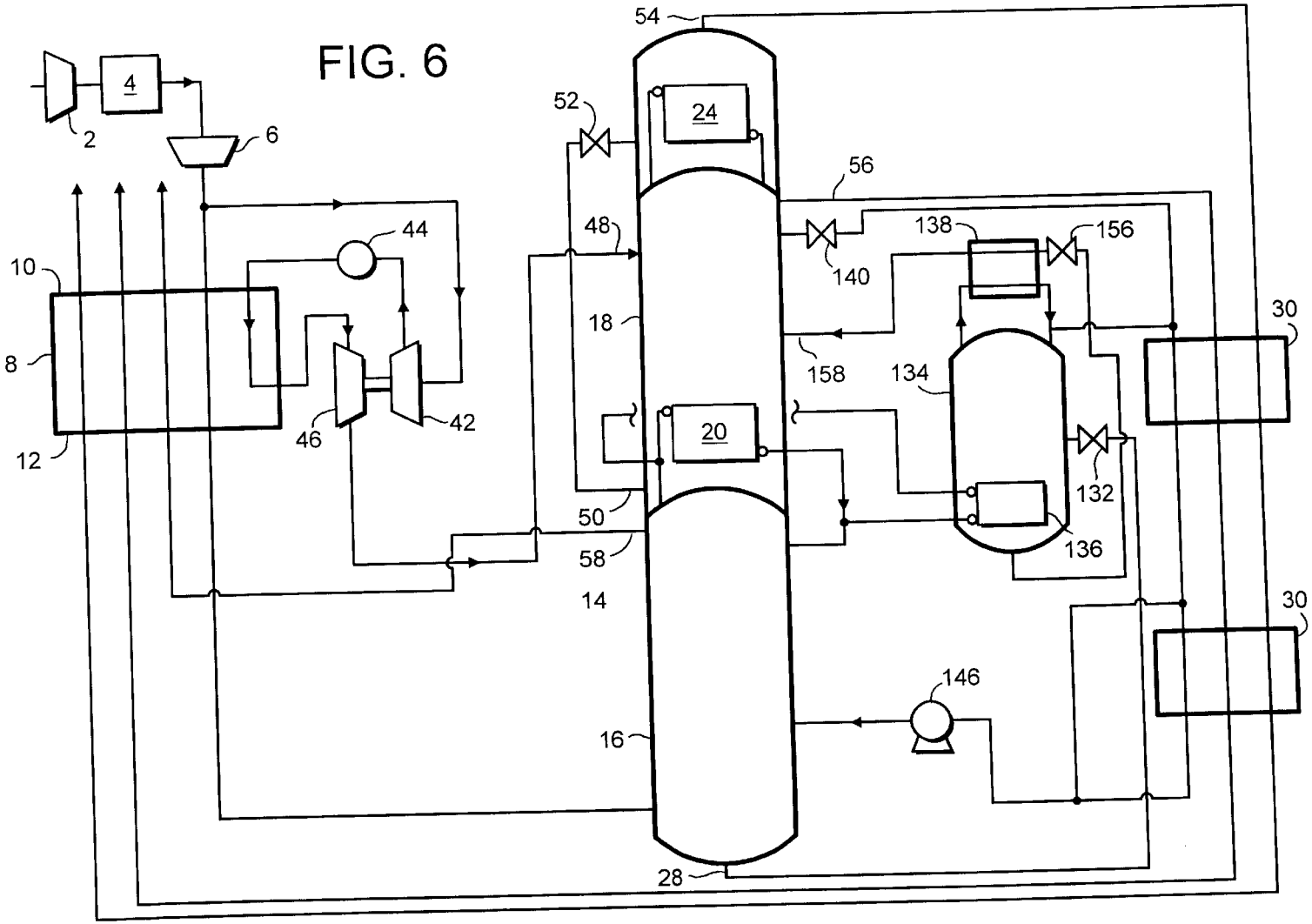
Figure 7:
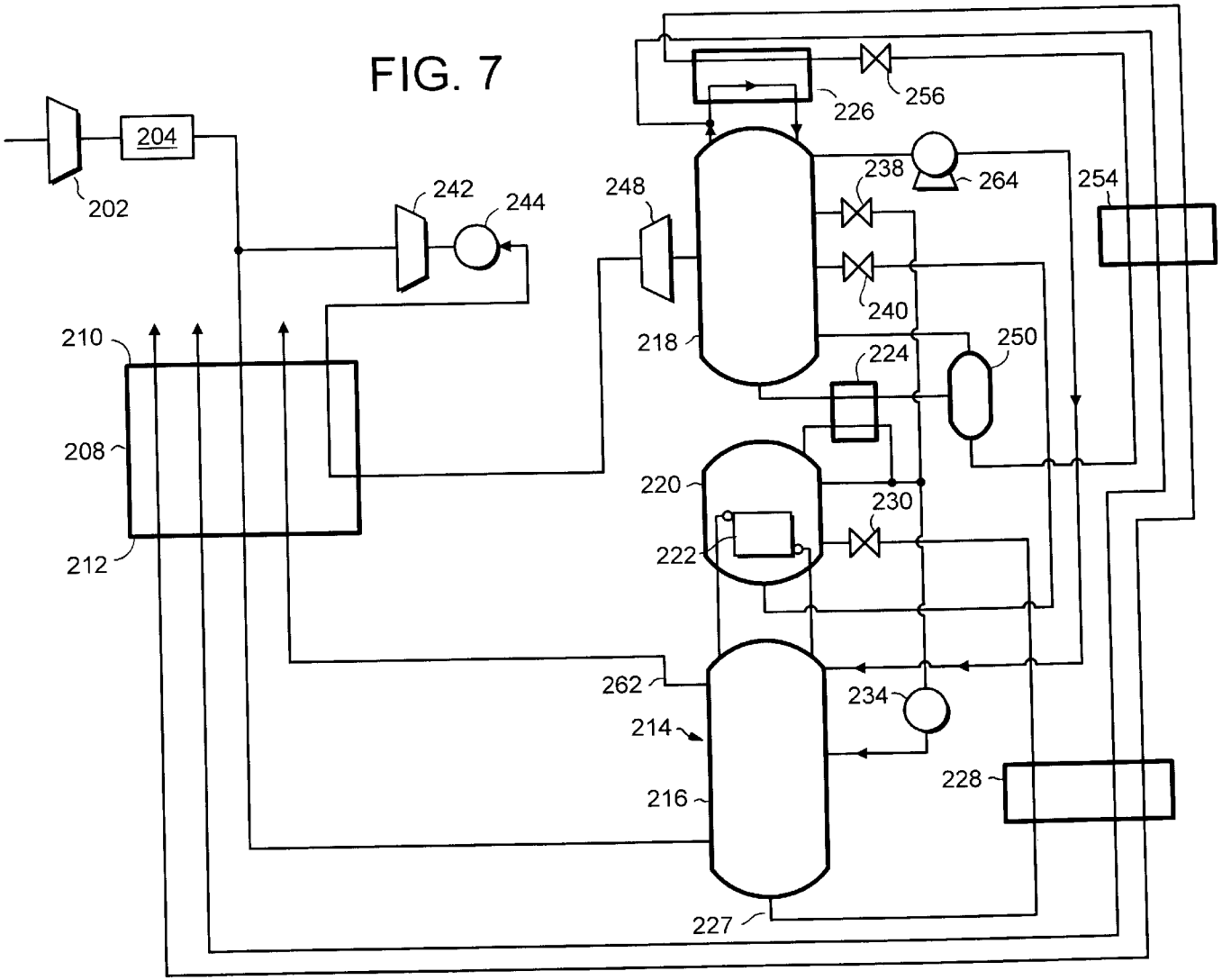

Referring to the drawings, FIGS. 1 to 5 all illustrate examples of the method and apparatus according to the invention in which a first auxiliary rectification column is used in conjunction with a double rectification column. In FIG. 5, a second auxiliary rectification column is used in addition to the first auxiliary rectification column. FIG. 6 illustrates an example of the method and apparatus according to the invention in which a separation by partial vaporization (or alternatively in a second auxiliary rectification column), is employed in conjunction with a double rectification column. FIG. 7 illustrates an example of the method and apparatus according to the invention in which a triple rectification column is used.

Figure 1:
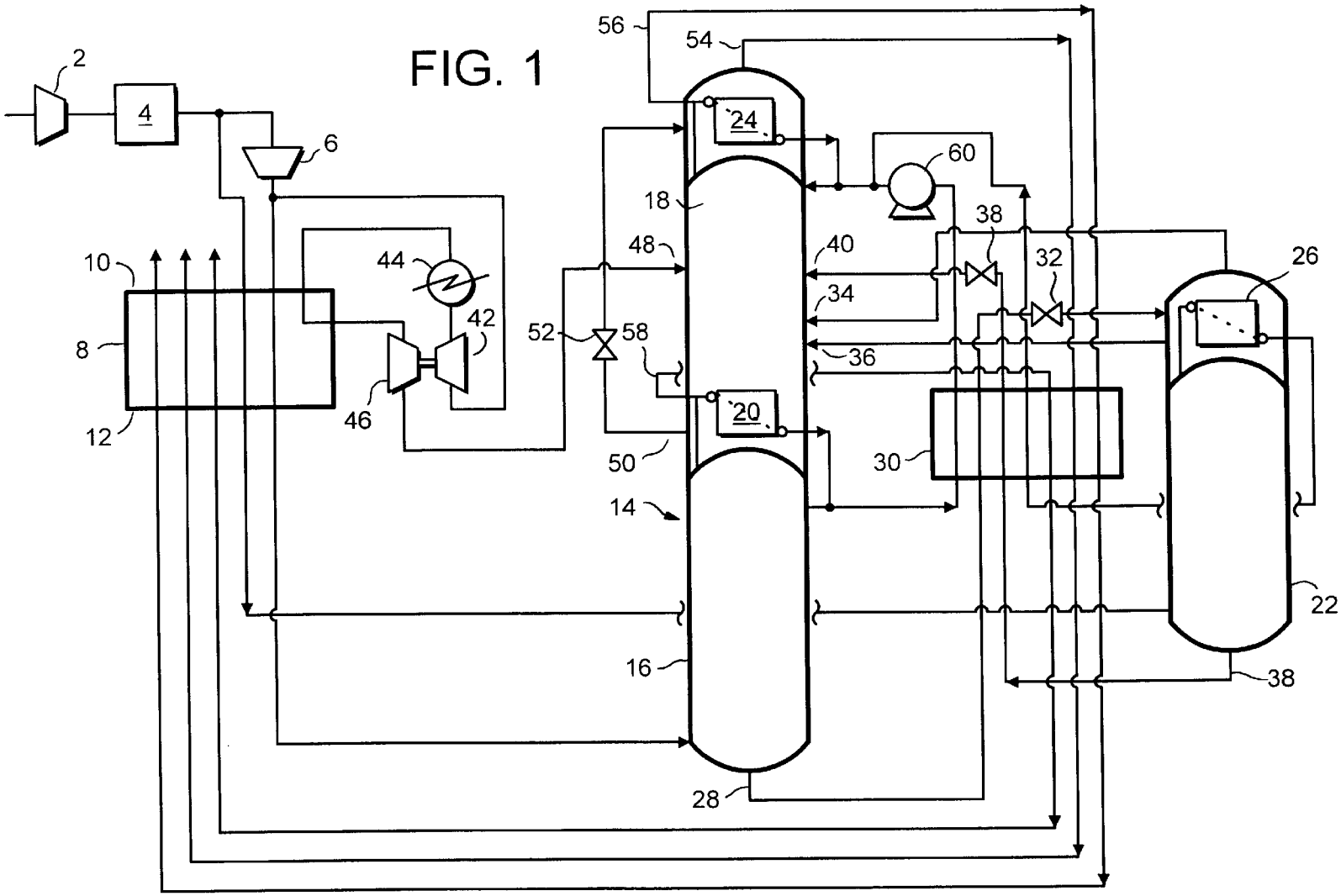
FIGS. 1 to 7 are all schematic flow diagrams of respective air separation plants.

Referring to FIG. 1 of the drawings, a flow of air is compressed in a main air compressor 2 which has an aftercooler (not shown) associated therewith, and is purified in an adsorption unit 4. The purification comprises removal from the air flow of impurities with relatively high boiling point, particularly water vapor and carbon dioxide, which would otherwise freeze in low temperature parts of the plant. The unit 4 may effect the purification by pressure swing adsorption or temperature swing adsorption. The unit 4 may additionally include one or more layers of catalyst for the removal of carbon-monoxide and hydrogen impurities. Such removal of carbonmonoxide and hydrogen impurities is described in EP-A-438 282. The construction and operation of such adsorptive purification units are well known and need not be described further herein. Downstream of the purification unit 4, the air is divided into a first air stream and a second air stream. The first air stream is further compressed by compression in a further compressor 6, having an aftercooler (not shown) associated therewith. The second air stream bypasses the further air compressor 6. The purified second air stream and the majority of the further compressed, purified, first air stream, flow through a main heat exchanger 8 from its warm end 10 to its cold end 12. The air is thus cooled to a temperature suitable for its separation by rectification and hence leaves the cold end 12 of the main heat exchanger 8 in vaporous state.

The compressed, vaporous, first air stream is separated in a double rectification column 14 comprising a higher pressure rectification column 16, a lower pressure rectification column 18, and a condenser-reboiler 20, of which the condensing passages (not shown) communicate with an upper region of the higher pressure rectification column 16 so as to condense nitrogen separated therein, and the reboiling passages (not shown) communicate with a lower region of the lower pressure rectification column 18.

The first stream of vaporous compressed air enters the bottom of a lower region of the higher pressure rectification column 16. The higher pressure rectification column 16 contains members (not shown) defining liquid-vapor contact surfaces so as to bring into intimate mass transfer relationship the vapor ascending the column with liquid nitrogen condensed in the condenser-reboiler 20. As a result, nitrogen is separated from the first stream of compressed, vaporous, air.

The second stream of compressed, vaporous, air is introduced into the bottom of a lower region of the auxiliary rectification column 22. Nitrogen is separated from the air in the auxiliary rectification column 22 analogously to the manner in which it is separated in the higher pressure rectification column 16. To this end the column 22 is provided with liquid-vapor contact members (not shown). Nitrogen separated in the auxiliary rectification column 22 is condensed in a second further condenser 26. A part of the resulting condensed nitrogen is returned to the further rectification column 22 so as to provide reflux for this column.

A stream of oxygen-enriched liquid is withdrawn from the bottom of the lower region of the higher pressure rectification column 16 through an outlet 28, flows through a further heat exchanger 30, thereby being sub-cooled, passes through a throttling valve 32, and is introduced into the second further condenser 26 so as to condense by indirect heat exchange the nitrogen separated in the auxiliary rectification column 22. As a result, the stream of oxygen-enriched liquid is partially vaporized. A flow of resulting vapor is introduced through an inlet 34, and a flow of residual liquid is introduced through an inlet 36, into the lower pressure rectification column, 18 for separation therein. In addition, a flow of oxygen-enriched liquid is withdrawn from the bottom of a lower region of the auxiliary rectification column 22 through an outlet 38, is sub-cooled by passage through the heat exchanger 30, is reduced in pressure by passage through a throttling valve 39 and is introduced into the lower pressure rectification column 18 through an inlet 40 for separation therein. Another stream for separation in the lower pressure rectification column 18 is formed by withdrawing a part of the further compressed first air stream upstream of the warm end 10 of the main heat exchanger 8, compressing it to a yet higher pressure in a booster-compressor 42, cooling the air so as to remove heat of compression therefrom in an aftercooler 44, further cooling this air stream by passage through the main heat exchanger 8 from its warm end 10, withdrawing the further cooled air stream from an intermediate region of the main heat exchanger 8 at a temperature in the order of 140K, and expanding it with the performance of external work in a turbo-expander 46. The resultant expanded air stream is then introduced into the lower pressure rectification column 18 through an inlet 48. The turbo-expander 46 is driven by the booster-compressor 42 and, as shown in FIG. 1, is coupled to the booster-compressor 42.

The various streams that are introduced into the lower pressure rectification column 18 are separated therein in a manner analogous to the separation of the air in the higher pressure rectification column 16. Liquid-vapor contact members (not shown) are provided in the column 18 for this purpose. Nitrogen is withdrawn from the top of the lower pressure rectification column 18 and is condensed in the first further condenser 24. At least a part of the resulting condensate is employed as reflux in the lower pressure rectification column 18. An upward flow of vapor through the column 18 is created by boiling liquid in the reboiling passages (not shown) of the condenser-reboiler 20. This boiling is performed by indirect heat exchange with condensing nitrogen in the condensing passages (not shown) of the condenser-reboiler 20. In order to effect condensation of the nitrogen in the first further condenser 24, a stream of oxygen-enriched liquid typically having an oxygen mole fraction in the order of 0.55 to 0.75, preferably between 0.65 and 0.72, is withdrawn from the bottom of the lower region of the lower pressure rectification column 18 through an outlet 50, is reduced in pressure by passage through a throttling valve 52, and is introduced into the condenser 24. As a result of heat exchange with the condensing nitrogen in the condenser 24 the oxygen-enriched liquid is vaporized. The resulting vapor is withdrawn from the condenser 24 through an outlet 54, is warmed by passage through the heat exchanger 30, thereby providing some of the cooling necessary for the sub-cooling of streams therein, and is further warmed to approximately ambient temperature by passage through the main heat exchanger from its cold end 12 to its warm end 10. The oxygen-enriched stream may be vented from the warm end 10 of the main heat exchanger 8 as a waste product.

A lower pressure nitrogen product stream is withdrawn from the top of the lower pressure rectification column and flows along a conduit 56 to a further heat exchanger 30. The lower pressure nitrogen stream is warmed by passage through the further heat exchanger 30, thereby providing some of the cooling necessary for the sub-cooling streams therein. The warmed lower pressure nitrogen stream flows from the heat exchanger 30 through the main heat exchanger 8 from its cold end 12 to its warm end 10 and is thereby warmed to approximately ambient temperature. The lower pressure nitrogen stream may, if desired, be further compressed. A higher pressure nitrogen product is withdrawn from the top of the higher pressure rectification column 16 and flows along a conduit 58 to the further heat exchanger 30. Similarly to the other nitrogen stream, it is warmed by passage through this heat exchanger and flows through the main heat exchanger 8 from its cold end 12 to its warm end 10, and may be taken as product at approximately ambient temperature. If desired the higher pressure nitrogen product may be further compressed.

As previously mentioned, nitrogen condensate is formed in the condenser-reboiler 20 and in the first and second further condensers 24 and 26, respectively. The second further condenser 26 condenses nitrogen at a rate in excess of the requirements for reflux of the auxiliary rectification column 22. The excess nitrogen condensate is therefore exported to the double rectification column 14. Typically, as shown in the drawing, the excess nitrogen condensate from the second further condenser 26 together with similar excess nitrogen condensate from the first further condenser is pumped by the pump 60 to supplement the liquid nitrogen reflux in the higher pressure rectification column 16. Alternatively, depending on the operating parameters of the plant, the condenser-reboiler 20 may produce liquid nitrogen in excess of the requirements for reflux of the higher pressure rectification column 16. The excess liquid nitrogen together with the excess liquid nitrogen produced in the second condenser 26 may be employed as reflux in the lower pressure rectification column 18. In another alternative, excess liquid nitrogen may be taken as product. In a first typical example of the operation of the plant shown in FIG. 1, the higher pressure rectification column 16 may be operated at a pressure of about 8.3 bar at its bottom, the lower pressure rectification column 18 at a pressure of about 3.8 bar at its bottom and the auxiliary rectification column 22 at a pressure of about 6.0 bar at its bottom.

In this first example, the waste oxygen-enriched stream has a mole fraction of oxygen equal to 0.622 (corresponding to 85% recovery of nitrogen), 71.5% of the air is supplied to the higher pressure rectification column 16 at a pressure of 8.25 bar, 17.5% of the air is supplied to the auxiliary rectification column 22 at a pressure of 6.0 bar, and 11% of the air is supplied to the lower pressure rectification column 18 from the turbo-expander 46 at a pressure of 3.9 bar. 60.5% the nitrogen product is taken from the higher pressure rectification column 16 and 39.5% from the lower pressure rectification column 18.

In a comparative example, at the same nitrogen recovery, the auxiliary rectification column 22 and its associated condenser 26 are omitted. The higher pressure and lower pressure rectification columns are operated at the same pressures as in the example above. All the air which had previously been sent to the auxiliary rectification column 22 is instead included in the air that flows into the higher pressure rectification column. Accordingly extra power is consumed in raising this fraction of the air to the pressure of the higher rectification column, i.e. some 17.6% of the total incoming air flow is provided at a pressure 2.25 bar higher than in the example above. Thus, the example according to the invention exhibits a lower total power consumption.

In a second example of operation of the plant shown in FIG. 1, the waste oxygen-enriched stream has a mole fraction of oxygen equal to 0.694 (corresponding to 89% recovery of nitrogen). Now the higher pressure rectification column 16 is operated with a pressure at its bottom of 9.1 bar, the auxiliary rectification column 22 with a pressure at its bottom of 6.5 bar, and the lower pressure rectification column 18 with a pressure of 4.2 bar at its bottom. In this example 44% of the nitrogen product is taken from the higher pressure rectification column 16 and 56% from the lower pressure rectification column. Although the nitrogen recovery has been increased, thereby enabling the plant size to be reduced, the total power consumption has increased.

Figure 2:
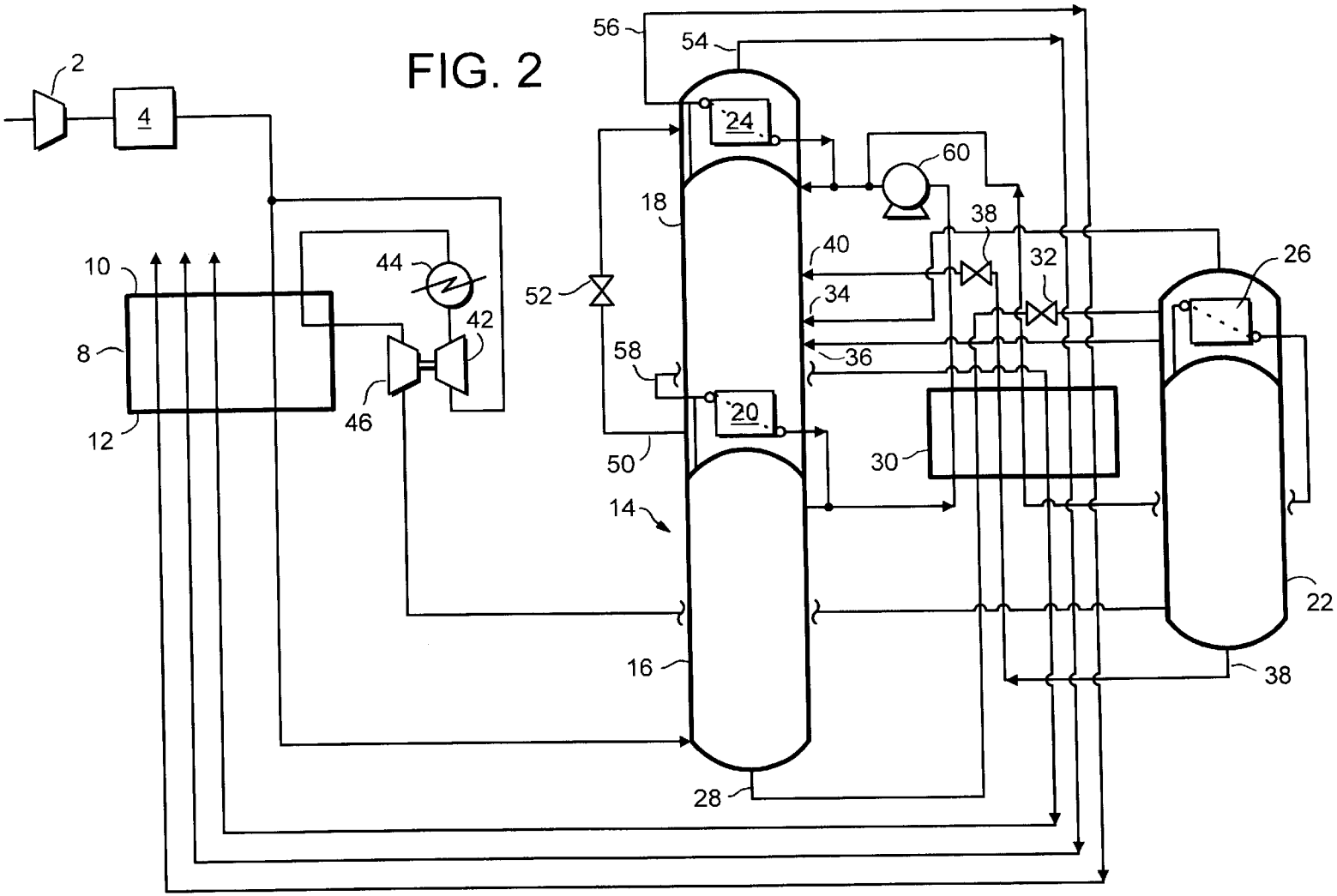

Various modifications may be made to the plant shown in FIG. 1. For example, in order to increase the recovery of nitrogen the oxygen mole fraction in the waste stream may be increased to 0.7. As a result, the condensing passages of the condenser-reboiler 20 need to operate at a higher pressure, and it is therefore necessary to raise the outlet pressure of the air compressor 6. Other modifications are shown in FIGS. 2 to 5 of the accompanying drawings. Referring now to FIG. 2, the plant shown therein is generally similar to that shown in FIG. 1 except that the further compressor 6 and its associated aftercooler are omitted and the turbo-expander 46 exhausts into the auxiliary pressure rectification column 22 instead of the lower pressure rectification column 18. This arrangement has the advantage of reducing the number of passes through the main heat exchanger 8 as well as eliminating the need for the compressor 6 shown in FIG. 1. Further the purification unit 4 may be operated at a higher pressure than the equivalent unit in the plant shown in FIG. 1.

Referring now to FIG. 3 of the accompanying drawings, the plant shown therein is generally similar to that shown in FIG. 2 except that the entire feed air flow passes through the booster-compressor 42. The flow of air is divided intermediate the aftercooler 44 and the warm end 10 of the main heat exchanger 8. One part of the split air flow passes through the main heat exchanger 8 from its warm end 10 to its cold end 12 as the first air stream and enters the higher pressure rectification column 16. The other part of the split air flow is cooled to a temperature in the order of 140K in the main heat exchanger 8 and is expanded in the turbo-expander 46 which exhausts into the auxiliary rectification column 22.

Referring now to FIG. 4 of the drawings, the plant shown therein is generally similar to that shown in FIG. 1 with the following exceptions. First, some of the first air stream is, downstream of the main heat exchanger 8, partially or totally condensed in a condenser 70 and is introduced through an inlet 72 into an intermediate mass exchange region of the higher pressure rectification column 16. Second, no high pressure nitrogen product is taken in the vapor state from the top of the higher pressure rectification column 16. Instead, a stream of condensed liquid nitrogen is pumped from the top of the higher pressure rectification column 16 by a pump 74 through the further heat exchanger 30 and is vaporized in the heat exchanger 70 in indirect heat exchange relationship with the air condensing therein. Thus, the necessary cooling for the condensation of the air is provided. In order to keep down the temperature difference between the vaporizing and condensing streams in the heat exchanger 70, the pump 74 raises the pressure of the liquid nitrogen to a pressure above that at the top of the higher pressure rectification column 16. The vaporized nitrogen passes from the heat exchanger 70 and is warmed to approximately ambient temperature by passage through the main heat exchanger 8 from its cold end 12 to its warm end 10. This flow of nitrogen is taken as the high pressure nitrogen product. A third difference is that a liquid stream comprising oxygen and nitrogen, having approximately the same composition as air, is withdrawn from the higher pressure rectification column 16 through an outlet 76 at the same level as the inlet 72. The liquid mixture is sub-cooled by passage through the further heat exchanger 30, is passed through a throttling valve 78, and is introduced into the lower pressure rectification column 18 for separation.

In comparison with the plant in FIG. 1 "internally compressing" the nitrogen by means of the pump 74 enables the operating pressures of the rectification columns to be raised. In comparison the first example of the operation of the plant shown in FIG. 1, the pressure at the bottom of the higher pressure rectification column of the plant shown in FIG. 4 may be raised by about 4 bar to 12.25 bar while still obtaining a nitrogen recovery of 66%. However, only 44% of the nitrogen product can now be taken from the higher pressure rectification column. In effect introducing the internal compression step has the effect of shifting work of "external"compression from the nitrogen compressors (not shown) to the air compressor 2. Referring now to FIG. 5 of the accompanying drawings, the plant shown therein and its operation are generally similar to that shown in FIG. 4 with the general exception that the plant shown in FIG. 5 includes an additional rectification column 80 provided with a reboiler 82 and a condenser 84 in order to supplement with impure liquid nitrogen the liquid nitrogen condensate formed in the condenser-reboiler 20 of the double rectification column 14. Thus, instead of feeding the stream of liquid mixture withdrawn through the outlet 76 to the lower pressure rectification column 18, this stream is introduced into a bottom region of the rectification column 80 and is separated therein. To this end, the valve 78 communicates at its outlet side with the bottom of the column 80. A part of the resulting liquid collecting in the bottom of the column 80 is reboiled by the reboiler 82 to form an ascending vapor stream. Mass exchange takes place between the stream and a descending liquid reflux stream. As a result impure nitrogen vapor is formed at the top of the column 80. This nitrogen vapor typically contains from 5 to 15% by volume of oxygen. It is condensed in the condenser 84. A part of the condensate forms the reflux for the column 80, and the remainder passes through a throttling valve 86 and enters the lower pressure rectification column 18 to supplement the liquid reflux therein.

A stream of oxygen-enriched liquid is withdrawn from the bottom of the rectification column 80, is reduced in pressure by passage through a throttling valve 88, and is employed to cool the condenser 84. The oxygen-enriched liquid stream is vaporized in the condenser 84 by indirect heat exchange with the condensing impure nitrogen. The resulting vapor is introduced into the lower pressure rectification column 18 through an inlet 90. The reboiler 82 is heated by a stream of nitrogen vapor withdrawn from the top of the higher pressure rectification column. The resulting condensate is returned as reflux to the top of the higher pressure rectification column 16.

The effect of introducing the additional rectification column 80 into the plant shown in FIG. 5, in comparison with the plant shown in FIG. 4, is to enable a greater proportion of the nitrogen product to be taken from the higher pressure rectification column 16, or to enable an increased proportion of the air to be separated in the auxiliary rectification column 22 without loss of nitrogen recovery. In other words, the total power consumption can be reduced, either by reducing the work of "external" compression of the nitrogen or by reducing the work of compression of the air.

Referring now to FIG. 6, the plant shown therein has a number of similarities to that shown in FIG. 1, employing an analogous arrangement of compressors 2, 6, and 42 and turbo-expander 46, and an analogous purification unit 4, main heat exchanger 8 and double rectification column 14. However, the auxiliary rectification column 22 is omitted and there is therefore no passage through the main heat exchanger 8 for a stream of air at the operating pressure of the rectification column 22. Instead, the stream of oxygen-enriched liquid which is taken from the bottom of the higher pressure rectification column 16 is flashed through a throttling valve to form a mixture of flash gas and residual liquid, the mixture is separated in a phase separator, and the residual liquid is partially reboiled in order to form liquid and vapor streams that are fed to the double rectification column 14. Accordingly, the stream of oxygen-enriched liquid taken from the outlet 28 of the higher pressure rectification column 16, is sub-cooled in a higher temperature section of the further heat exchanger 30. (As shown in FIG. 6, the further heat exchanger 30 has higher temperature and lower temperature sections which are separate from one another, although they could form part of a single unit.) The sub-cooled oxygen-enriched liquid is flashed through a throttling valve 132 into a phase separator 134 in which the resulting flash gas is separated from residual liquid. The residual liquid is partially vaporized in a vaporizer 136. The vapor phase in the phase separator 134 consists of impure nitrogen typically containing from 10 to 15% by volume of oxygen. A flow of this nitrogen is withdrawn from the top of the phase separator 134 and is condensed in a condenser 138. The resulting condensate is divided into four separate streams. A first of these streams is sub-cooled by passage through the lower temperature section of the further heat exchanger 30, is reduced in pressure by passage through a throttling valve 140 and is introduced into the lower pressure rectification column 18 as an impure liquid nitrogen reflux stream. A second stream of the nitrogen condensate from the condenser 138 is returned to the phase separator 134. The third and fourth streams are pumped by a pump 146 into an intermediate mass exchange region of the higher pressure rectification column 16, the third stream being warmed by passage through the higher temperature section of the further heat exchanger 30 and the fourth stream bypassing the heat exchanger 30. Introduction of the third and fourth streams into the higher pressure rectification column 16 helps to enhance the liquid-vapor ratio in the lower region of the column 16, thereby enabling more nitrogen to be taken as product from the higher pressure rectification column 16.

Heating for the vaporizer 136 is provided by a stream of nitrogen vapor withdrawn from the top of the higher pressure rectification column 16. The nitrogen is condensed as a result of its indirect heat exchange with the vaporizing liquid in the vaporizer 136. The nitrogen condensate is returned to the top of the rectification column 16 as reflux. A stream of oxygen-enriched liquid is withdrawn from the bottom of the phase separator 134, is reduced in pressure and temperature by passage through a throttling valve 156 and is employed to provide the necessary cooling for the condenser 138. As a result, the oxygen-enriched liquid stream is at least partially vaporized. The resulting stream is introduced into the lower pressure rectification column 18 through an inlet 158.

Analogous product streams are taken to those of the plant shown in FIG. 1, with the exception that the high pressure nitrogen stream withdrawn through the outlet 58 bypasses the further heat exchanger 30.

In a modification to the plant shown in FIG. 6, the phase separator 134 may be replaced by a further installation column typically containing up to 15 theoretical trays.

The plant shown in FIG. 6 enables the higher pressure rectification column 16 to be operated at a pressure corresponding to those at which this column is operated in the plants shown in FIGS. 4 and 5 without loss of nitrogen recovery. Further, a similar proportion of the nitrogen product to that in the plant shown in FIG. 5 may be taken from the higher pressure rectification column. However, with the omission of the auxiliary rectification column 22, more work needs to be expended in compressing the incoming air.

Referring now to FIG. 7 of the accompanying drawings, a flow of air is compressed in a main compressor 202, is cooled in an aftercooler (not shown) and has water vapor, carbon dioxide and other impurities removed therefrom in a purification unit 204. The purification unit 204 and its operation are analogous to the purification unit 4 described here and above with reference to FIG. 1. The flow of purified air is divided into two streams. A first of these streams flows through a main heat exchanger 208 from its warm end 210 to its cold end 212 and is thereby cooled to a temperature suitable for its separation by rectification. This separation is performed in a triple rectification column 214, comprising a higher pressure rectification column 216, a lower pressure rectification column 218, an intermediate pressure rectification column 220, a first condenser-reboiler 222 having condensing passages communicating with an upper region of the higher pressure rectification column 216 and reboiling passages communicating with a lower region of the intermediate pressure rectification column 220, and a second condenser-reboiler 224 having condensing passages communicating with an upper region of the intermediate pressure rectification column 220 and reboiling passages communicating with the lower region of the lower pressure rectification column 218. The upper region of the lower pressure rectification column 218 communicates with a condenser 226. The rectification columns 216, 218 and 220 all contain liquid-vapor contact members (not shown) to enable mass exchange to take place between ascending vapor and descending liquid. The liquid-vapor contact members may be distillation trays, or packing such as structured packing.

The first air stream is introduced into a bottom region of the higher pressure rectification column 216 and has nitrogen and has nitrogen separated from it. The nitrogen is condensed in the first condenser reboiler 222 and all the resulting condensate is returned to the column 216 as reflux. A stream of oxygen-enriched liquid is withdrawn from the bottom of the higher pressure rectification column 216 through an outlet 227, is sub-cooled in a further heat exchanger 228, is reduced in pressure by passage through a throttling valve 230 and is introduced into the bottom of the intermediate pressure rectification column 220.

The liquid in the bottom of the column 220 is partially reboiled by the first condenserreboiler 222. Impure nitrogen is separated from this vapor in the column 220. A stream of impure nitrogen is withdrawn from an upper region of the intermediate pressure rectification column 220, this stream typically containing about 10% by volume of oxygen. The impure nitrogen stream is condensed in the second condenser reboiler 224. A first part of the stream is returned to the top of the intermediate pressure rectification column 220 as reflux. A second part of the stream is passed by a pump 234 into an intermediate mass exchange region of the higher pressure rectification column 216 and thereby provides reflux for the lower region of the column 216. By so employing this impure liquid nitrogen stream in the higher pressure rectification column 216, the proportion of the total nitrogen product which can be taken from the top of the column 216 is enhanced. A third part of the stream is reduced in pressure by passage through a throttling valve 238 and is introduced into the lower pressure rectification column 218.

A stream of oxygen-enriched liquid is withdrawn from the bottom of the intermediate pressure rectification column 220, is reduced in pressure by passage through a throttling valve 240 and is introduced into the lower pressure rectification column 218 for separation therein. A further stream of fluid for separation in the column 218 is formed from the second stream of purified air. This stream is further compressed in a compressor 242, is cooled in an aftercooler 244, is further cooled by passage through the main heat exchanger 208 to a temperature of about 135K, is taken from the heat exchanger 208 at this temperature, is expanded with the performance of external work in a turbo-expander 248 and is introduced into the lower pressure rectification column 218 for separation therein. The streams introduced into the lower pressure rectification column 218 are separated into relatively pure nitrogen containing less than 0.1% by volume of impurities at the top of the column 218 and an impure liquid oxygen fraction typically containing from 55 to 70% by volume of oxygen at the bottom of the column.

A first stream of nitrogen vapor is withdrawn from the top of the column 218, is condensed in the condenser 226 and is returned to the column 218 as reflux. A stream of the oxygen-enriched liquid is withdrawn from the bottom of the rectification column 218, and is partially reboiled in the second condenser-reboiler 224. The partially reboiled stream has liquid disengaged from attendant vapor in a phase separator 250. The resulting vapor phase is returned to the bottom of the column 218. A stream of the residual liquid is sub-cooled by passage through a heat exchanger 254, is reduced in pressure by passage through a throttling valve 256 and is introduced into the condenser 226 so as to provide the cooling necessary for the condensation of nitrogen therein. As a result, the oxygen-enriched liquid stream is vaporized. The resulting oxygen-enriched vapor flows through the heat exchangers 254 and 228 and thereby provides some of the necessary cooling for these heat exchangers. The oxygen-enriched vapor flows from the heat exchanger 228 and passes through the main heat exchanger 208 from its cold end 212 to its warm end 210. It is typically vented from the plant to the atmosphere as a waste stream. A second stream of nitrogen is withdrawn from the lower pressure rectification column 218 as product, and flows through the heat exchangers 254, 228 and 208, in sequence, thereby providing the rest of the cooling for the heat exchanger 254 and 228. A low pressure nitrogen product stream is thus formed at approximately ambient temperature. In addition, a high pressure nitrogen product stream is taken from the top of the higher pressure rectification column 216 through an outlet 262 and is warmed to approximately ambient temperature by passage through the main heat exchanger 208.

Typically, the condenser 226 condenses more nitrogen than is needed as reflux in the low pressure rectification column 218. The excess liquid nitrogen reflux is passed by a pump 264 into the higher pressure rectification column 216 to supplement the reflux therein.

In a typical example of operation of the air separation plant shown in FIG. 7, the pressure at the top of the higher pressure rectification column 216 is about 10.5 bar, at the top of the lower pressure rectification column 218 is about 4 bar, and at the top of the intermediate pressure rectification column 220 is about 6.5 bar. The turbo-expander 248 has an inlet pressure of 13.6 bar. Approximately 80% of the nitrogen product is taken through the outlet 262 from the higher pressure rectification column 216. The nitrogen recovery is 86%.

We claim:

1. A method of producing nitrogen, comprising:

separating nitrogen from air and condensing nitrogen so separated;

wherein at least part of the nitrogen is separated by rectification; and at least some of the condensed nitrogen is employed as reflux in the rectification;

the nitrogen being both separated and condensed at no less than three different pressures; wherein:

a first stream of compressed vaporous air is separated in a double rectification column comprising a higher pressure rectification column in which nitrogen is produced at a first pressure, a lower pressure rectification column in which nitrogen is produced at a second pressure lower than the first pressure, and a condenser-reboiler, of which the condensing passages communicate with an upper region of the higher pressure rectification column so as to condense nitrogen at the first pressure, and the reboiling passages communicate with a lower region of the lower pressure rectification column; and a stream of nitrogen is taken from an upper region of the lower pressure rectification column and is condensed at the second pressure.

2. The method according to claim 1, in which a stream of oxygen-enriched liquid is withdrawn from the lower region of the lower pressure rectification column and is employed to condense the nitrogen at the second pressure.

3. The method according to claim 1, in which a second stream of compressed vaporous air has nitrogen separated from it in a first auxiliary rectification column at a third pressure and nitrogen so separated is condensed, wherein the third pressure being less than the first but greater than the second pressure.

4. The method according to claim 3, in which:

a stream of oxygen-enriched liquid is withdrawn from the lower region of the higher pressure rectification column, is reduced in pressure, and is indirectly heat exchanged with a flow of nitrogen separated in the first auxiliary rectification column so as to effect the condensation of the flow of nitrogen separated in the auxiliary rectification column; and downstream of its heat exchange with the flow of nitrogen separated in the first auxiliary rectification column, the oxygen-enriched liquid is subjected to separation in the lower pressure rectification column.

5. The method according to claim 1, in which a stream of liquid is withdrawn from the lower region of the higher pressure rectification column, is reduced in pressure, and has nitrogen separated therefrom in a second auxiliary rectification column at a fourth pressure which is less than the first pressure but is greater than the second pressure, and nitrogen so separated is condensed, and liquid collecting in a lower region of the second auxiliary rectification column is reboiled.

6. The method according to claim 1, in which a stream of liquid is withdrawn from the lower region of the higher pressure rectification column, is reduced in pressure, has nitrogen separated therefrom in a second auxiliary column at a fourth pressure which is less than the first pressure but is greater than the second pressure, nitrogen so separated is condensed, liquid collecting in a lower region of the second auxiliary rectification column is reboiled, a stream of liquid is withdrawn from a lower region of the second auxiliary rectification column, is reduced in pressure, and is indirectly heat exchanged with a flow of nitrogen separated in the second auxiliary rectification column so as to effect the condensation of the said flow, and, downstream of its heat exchange with the flow of nitrogen separated in the second auxiliary rectification column, is introduced into the lower pressure rectification column and is separated therein.

7. The method as claimed in claim 1, in which a stream of liquid is withdrawn from a lower region of the higher pressure rectification column and is flashed through a valve so as to form at a fifth pressure less than the first pressure and greater than the second pressure a mixture of flash gas and residual liquid, the residual liquid is partially vaporized, resulting impure nitrogen gas is separated by being disengaged from the residual liquid, the impure nitrogen gas is condensed at the fifth pressure, and at least a part of the condensed impure nitrogen is introduced into an intermediate region of the higher pressure rectification column.

8. The method as claimed in claim 7, in which a stream of the residual liquid is reduced in pressure and is indirectly heat exchanged with a stream of the impure nitrogen so as to condense the impure nitrogen, and downstream of its heat exchange with the impure nitrogen the stream of residual liquid is introduced into the lower pressure rectification column.

9. A method of producing nitrogen, comprising:

separating nitrogen from air and condensing nitrogen so separated;

wherein at least part of the nitrogen is separated by rectification; and at least some of the condensed nitrogen is employed as reflux in the rectification;

the nitrogen being both separated and condensed at no less than three different pressures;

in which a first stream of air is separated in a triple rectification column comprising a higher pressure rectification column in which nitrogen is produced at a first pressure, a lower pressure rectification column in which nitrogen is produced at a second pressure lower than the first pressure, an intermediate pressure rectification column in which nitrogen is produced at a third pressure lower than the first pressure but higher than the second pressure, a first condenser-reboiler of which the condensing passages communicate with an upper region of the higher pressure rectification column so as to condense nitrogen at the first pressure, and the reboiling passages communicate with a lower region of the intermediate pressure rectification column, and a second condenser-reboiler, of which the condensing passages communicate with an upper region of the intermediate pressure rectification column so as to condense nitrogen at the third pressure, and the reboiling passages communicate with a lower region of the lower pressure rectification column; and in which a stream of liquid is withdrawn from a region of the lower pressure rectification column, is reduced in pressure, and is indirectly heat exchanged with a flow of nitrogen vapor separated in the lower pressure rectification column so as to condense the flow of nitrogen vapor.

10. An apparatus for producing nitrogen comprising:

an arrangement of separation vessels for separating nitrogen from air;

at least some of the separation vessels being rectification columns; and a plurality of condensers for condensing the nitrogen arranged to return, in use, at least some of the condensed nitrogen to the rectification columns to serve as reflux therein;

at least three of the nitrogen condensers arranged to condense nitrogen at different pressures from one another, the nitrogen condensers being in communication with different of said separation vessels configured to operate at different pressures from one another.

11. The apparatus according to claim 10, in which all the separation vessels are rectification columns.

12. The apparatus according to claim 10, in which one of the separation vessels is a phase separator adapted to separate a mixture with vapor and liquid, and has a vaporizer associated therewith for partially vaporizing liquid.

13. The apparatus according to claim 10, wherein:

some of the separation vessels are provided by a double rectification column separating a first stream of compressed vaporous air, comprising a higher pressure rectification column for producing nitrogen at a first pressure, a lower pressure rectification column for producing nitrogen at a second pressure lower than the first pressure, and a condenser-reboiler of which the condensing passages communicate with an upper region of the higher pressure rectification column so as to condense nitrogen at the first pressure, and the reboiling passages communicate with the lower region of the lower pressure rectification column; and the apparatus further comprises a first further condenser for condensing at the second pressure nitrogen separated in the lower pressure rectification column.

14. The apparatus according to claim 13, wherein a further separation vessel is provided by a first auxiliary rectification column for separating a second stream of compressed vaporous air at a third pressure lower than the first pressure but higher than the second pressure, the first auxiliary rectification column having associated therewith a second further condenser for condensing at the third pressure nitrogen separated, in use, in the first auxiliary rectification column.

15. The apparatus according to claim 13, wherein a further separation vessel is provided by a second auxiliary rectification column, having a reboiler associated therewith, for separating at a fourth pressure lower than the pressure but higher than the second pressure, a stream of liquid comprising oxygen and nitrogen withdrawn, in use, from the higher pressure rectification column, the second auxiliary rectification column also having a third further condenser associated therewith for condensing at the fourth pressure nitrogen separated in the second auxiliary pressure rectification column.

16. The apparatus according to claim 13, wherein some or all of the separation vessels are provided by a triple rectification column for separating a first stream compressed vaporous air, comprising a higher pressure rectification column for producing nitrogen at first pressure, a lower pressure rectification column for producing nitrogen at a second pressure lower than the first pressure, an intermediate pressure rectification column for producing nitrogen at a third pressure lower than the first pressure but higher than the second pressure, a first condenser-reboiler, of which the condensing passages communicate with an upper region of the higher pressure rectification column so as, in use, to condense nitrogen at the first pressure, and the reboiling passages communicate with a lower region of the intermediate pressure rectification column, and a second condenser-reboiler, of which the condensing passages communicate with an upper region of the intermediate pressure rectification column so as to condense nitrogen at the third pressure, and the reboiling passages communicate with a lower region of the lower pressure column.

17. The apparatus according to claim 16, wherein the lower pressure rectification column has associated therewith a condenser for condensing the nitrogen separated therein at the second pressure.

* * * * *